US007828933B2

(12) United States Patent
Okomori et al.

(10) Patent No.: US 7,828,933 B2
(45) **Date of Patent: *Nov. 9, 2010**

(54) COATED SHEET FOR ROTARY OFFSET PRINTING

(75) Inventors: Koji Okomori, Kita-ku (JP); Chizuru Wakai, Kita-ku (JP); Hirokazu Morii, Kita-ku (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 856 days.

This patent is subject to a terminal disclaimer.

(21) Appl. No.: 10/509,270

(22) PCT Filed: Sep. 27, 2002

(86) PCT No.: PCT/JP02/10111

§ 371 (c)(1),
(2), (4) Date: May 19, 2005

(87) PCT Pub. No.: WO03/038213

PCT Pub. Date: Oct. 9, 2003

(65) Prior Publication Data

US 2006/0005933 A1 Jan. 12, 2006

(30) Foreign Application Priority Data

| | | |
|---|---|---|
| Mar. 28, 2002 | (JP) | 2002-090076 |
| Mar. 28, 2002 | (JP) | 2002-093127 |
| Apr. 30, 2002 | (JP) | 2002-127974 |
| Aug. 30, 2002 | (JP) | 2002-256176 |

(51) Int. Cl.
*D21H 19/82* (2006.01)
*D21H 19/42* (2006.01)

(52) U.S. Cl. ..... 162/137; 162/135; 162/158; 162/164.1; 428/207; 428/219; 428/341

(58) Field of Classification Search ..... 162/135–137, 162/158, 169, 164.1, 168.1, 179; 428/207, 428/323, 339, 340–341, 219, 507, 32.1–32.38, 428/195.11; 427/361, 369, 391, 411
See application file for complete search history.

(56) References Cited

U.S. PATENT DOCUMENTS

| | | | | |
|---|---|---|---|---|
| 3,268,354 | A * | 8/1966 | Hain | 428/342 |
| 3,853,579 | A * | 12/1974 | Heiser | 428/323 |
| 4,317,849 | A | 3/1982 | Ogura et al. | |
| 5,122,568 | A * | 6/1992 | dePierne et al. | 524/824 |
| 5,139,614 | A * | 8/1992 | dePierne et al. | 162/135 |
| 5,270,103 | A * | 12/1993 | Oliver et al. | 428/219 |
| 5,302,439 | A * | 4/1994 | Malhotra et al. | 428/32.38 |
| 5,326,391 | A | 7/1994 | Anderson et al. | |
| 5,360,657 | A | 11/1994 | Kano et al. | |
| 5,451,466 | A * | 9/1995 | Malhotra | 428/32.1 |
| 5,576,088 | A * | 11/1996 | Ogawa et al. | 428/32.33 |
| 5,605,750 | A | 2/1997 | Romano et al. | |
| 5,648,420 | A * | 7/1997 | Fujiwara et al. | 524/750 |
| 5,663,022 | A * | 9/1997 | Malhotra | 430/125.6 |
| 5,709,976 | A * | 1/1998 | Malhotra | 430/124.54 |
| 5,750,200 | A * | 5/1998 | Ogawa et al. | 427/361 |
| 5,824,190 | A * | 10/1998 | Guerro et al. | 162/135 |
| 5,985,367 | A * | 11/1999 | Nishijima et al. | 427/361 |
| 6,020,058 | A * | 2/2000 | Pekala et al. | 428/32.34 |
| 6,458,413 | B1 * | 10/2002 | Hirabayashi et al. | 427/209 |
| 6,494,990 | B2 * | 12/2002 | Bazaj et al. | 162/168.3 |
| 6,783,847 | B1 * | 8/2004 | Minami et al. | 428/331 |
| 6,902,794 | B2 * | 6/2005 | Hirabayashi et al. | 428/195.1 |
| 7,101,459 | B2 * | 9/2006 | Nisogi et al. | 162/135 |
| 2001/0051687 | A1 * | 12/2001 | Bazaj et al. | 525/218 |
| 2002/0121351 | A1 * | 9/2002 | Takano et al. | 162/134 |
| 2003/0170574 | A1 * | 9/2003 | Rieger et al. | 430/523 |
| 2003/0194501 | A1 * | 10/2003 | Urscheler et al. | 427/420 |
| 2005/0089651 | A1 * | 4/2005 | Okomori et al. | 428/32.34 |
| 2006/0005933 | A1 * | 1/2006 | Okomori et al. | 162/137 |
| 2007/0048508 | A1 * | 3/2007 | Kishida et al. | 428/211.1 |
| 2008/0160232 | A1 * | 7/2008 | Sasaguri et al. | 428/32.33 |

FOREIGN PATENT DOCUMENTS

| | | | |
|---|---|---|---|
| CA | 2153182 | | 1/1996 |
| DE | 195 24 528 | A1 | 1/1996 |
| EP | 0430391 | | 6/1991 |
| EP | 631013 | A1 * | 12/1994 |
| EP | 1403427 | A1 * | 3/2004 |
| EP | 1489230 | A1 * | 12/2004 |
| JP | 57-093193 | A | 6/1982 |
| JP | 60-199999 | | 10/1985 |

(Continued)

OTHER PUBLICATIONS

The Office Action mailed Oct. 31, 2008 issued in U.S. Appl. No. 10/502,877, filed Mar. 28, 2005.

(Continued)

*Primary Examiner*—José A Fortuna
(74) *Attorney, Agent, or Firm*—Knobbe Martens Olson & Bear LLP

(57) ABSTRACT

A coated sheet for web offset printing which includes a pigment coating layer containing a pigment and an adhesive formed on a base paper, and a surface layer containing a surface-sizing agent and a plastic pigment formed on the pigment coating layer.

12 Claims, No Drawings

FOREIGN PATENT DOCUMENTS

| | | | | |
|---|---|---|---|---|
| JP | 64-010638 | | | 1/1989 |
| JP | 03-167396 | | | 7/1991 |
| JP | 04-272297 | A | | 9/1992 |
| JP | 08-013390 | | | 1/1996 |
| JP | 8-260389 | | | 10/1996 |
| JP | 9-268493 | | | 10/1997 |
| JP | 9-324395 | | | 12/1997 |
| JP | 2000-43408 | | | 2/2000 |
| JP | 2000-234292 | | | 8/2000 |
| JP | 2001-73295 | A | | 3/2001 |
| JP | 2002-129490 | | | 5/2002 |
| JP | 2002-363889 | | | 12/2002 |
| JP | 2002363888 | A | * | 12/2002 |
| JP | 2003155692 | A | * | 5/2003 |
| JP | 2003328294 | A | * | 11/2003 |
| JP | 2004091986 | A | * | 3/2004 |
| JP | 2005054331 | A | * | 3/2005 |
| WO | WO 02079573 | A1 | * | 10/2002 |
| WO | WO 03083213 | A1 | * | 10/2003 |
| WO | WO 2007069683 | A1 | * | 6/2007 |

OTHER PUBLICATIONS

Office Action issued by the European Patent Office dated Oct. 16, 2009 for the counterpart European Patent Application No. 02 807 139.7-2124.

* cited by examiner

COATED SHEET FOR ROTARY OFFSET PRINTING

This application is the U.S. National Phase under 35 U.S.C. §371 of International Application PCT/JP02/10111, filed on Sep. 27, 2002, which claims priority of Japanese Patent Application Nos. 2002-93127 filed on Mar. 2, 2002, 2002-90076 filed on Mar. 28, 2002, 2002-127974 filed on Apr. 30, 2002, and 2002-256176 filed on Aug. 30, 2002. The International Application was published under PCT Article 21(2) in a language other than English.

FIELD OF THE INVENTION

This invention relates to a coated sheet for web offset printing that provides excellent printability while minimizing the wrinkling of paper that usually occurs after the drying process following printing by a web offset press.

BACKGROUND OF THE INVENTION

There has been a strong demand in recent years for communicating the contents of printed matters visually in a more impactful manner by utilizing many photographs, illustrations and/or colors (hereinafter referred to as "visualization"). On the other hand, there is also an increased demand for reducing the weight of printed matters to preserve natural resources and save the costs of shipping. These two demands are mutually contradictory, because high-grade coated papers suitable for visualization are generally associated with higher basis weight of the base paper, higher coating weight and higher price, which does not meet the requirements for lightweight, low-cost papers. For the above reason, the market is demanding technologies that can provide lightweight and low-cost "low-grade" coated papers that offer lower basis weight and coating weight, while achieving the quality of higher-grade papers.

One of the important factors that affect the quality of coated papers is wrinkling, after drying section of web offset printing. In the drying process of web offset printing, moisture in the paper evaporates at different rates in the non-image area and the image area covered with ink. In the non-image area, the speed of moisture evaporation is faster than that in the image area. As a result, the non-image area starts to shrink first and the paper wrinkles in the machine direction.

This phenomenon of wrinkling becomes prominent on papers with a lower basis weight and therefore poses a major impediment in the efforts to develop lightweight coated papers.

Since wrinkling is caused by a differential evaporation speed of moisture in the paper, reducing the moisture content of the coated paper before printing is an effective way to suppress wrinkling.

However, although reducing the moisture content of the coated paper reduces the degree of wrinkling to some degree, wrinkling cannot be reduced to a sufficient level this way.

Also, as published in Japanese Patent Application Laid-open No. 11-350391, a method is proposed for suppressing the shrinking behavior of paper by coating on both sides of the base paper a layer of polyvinyl alcohol (PVA) with a saponification level of 85 mol percent or more in such a way that the dry weight of the paper will become 1 to 6 g/m$^2$. However, PVA has high viscosity and poor printability and is therefore unsuitable for use in a continuous printing operation. In fact, PVA-coated papers printed on continuous printing lines have often exhibited poor blister resistance.

SUMMARY OF THE INVENTION

In view of the conditions explained above, the present invention aims to provide a coated sheet for web offset printing that minimizes the wrinkling of paper that usually occurs after the drying process following printing by a web offset press.

The inventors of the present invention have carried out extensive studies to solve the problems described above. As a result, the inventors have obtained a coated paper for web offset printing that suppresses wrinkling in web offset printing, by way of forming a pigment coating layer on the base paper, and then forming a surface layer containing surface-sizing agents on the aforementioned pigment coating layer.

The surface layer proposed by the present invention should preferably contain surface-sizing agents and plastic pigments, but more preferably contain 50 parts by weight or more but not exceeding 95 parts by weight of surface-sizing agents to 100 parts by weight of all surface-sizing agents and plastic pigments combined, in order to provide improved printability, such as higher blister resistance, in addition to the effect of suppressing wrinkling.

The mechanism of why the surface layer proposed by the present invention suppresses wrinkling is considered as follows: It is assumed that wrinkling occurs in the hot-air drying process of web offset printing due to a differential shrinkage between image area and non-image area. When moisture in the paper evaporates in the drying process, the paper starts to shrink. In the image area covered with an ink film, moisture evaporation is suppressed and therefore the shrinkage of paper is small. When a clear coat of surface-sizing agents is applied over the coating layer, moisture evaporation will also be suppressed in the non-image area. As a result, the differential shrinkage will decrease and wrinkling will become less likely to occur.

The present invention can also improve printability by achieving higher blister resistance and higher ink impression stability, if plastic pigments and surface-sizing agents are used in combination.

In addition, the present invention is able to provide a coated sheet for web offset printing causing minimal wrinkling and offering excellent printability, by producing said coated sheet for web offset printing from a base paper and a coating layer containing pigments and adhesives, and also by adjusting the air permeability of the paper before printing to less than 80,000 seconds and then reducing the air permeability in the non-image area after printing by 8,000 seconds or more from the level before printing. The inventors have completed the present invention after discovering that this production method can achieve a coated sheet for web offset printing causing minimal wrinkling while offering excellent printability, thereby solving the problems described earlier.

With respect to the present invention, the absolute air permeability can still remain high even when it has been reduced by 8,000 seconds or more after web offset printing, if the air permeability before printing was 80,000 seconds or more. If the absolute air permeability is high, blisters occur more easily in the image area covered with ink. This property does not suit web offset printing.

In addition, it is important that the air permeability in the non-image area is reduced by 8,000 seconds or more, or preferably by 20,000 seconds or more, after printing, because this will reduce the differential air permeability between non-image area and image area and consequentially suppress wrinkling.

It has not been fully revealed why wrinkling can be suppressed by reducing the air permeability in the non-image area by 8,000 seconds or more after printing. However, the reason is assumed as follows: When the offset printed paper is dried, minute cracks generate at the surface of the coating layer, and air is released non-uniformly through these cracks. This reduces the air permeability in the non-image area while also decreasing slightly the air permeability in the image area covered with ink. As a result, the differential moisture evaporation rate between non-image area and image area decreases as a result of reduced differential air permeation between non-image area and image area, and consequently wrinkling is suppressed. If the drop in air permeability is less than 8,000 seconds, the differential air permeability between non-image area and image area remains high, which makes it difficult to suppress wrinkling to a sufficient level.

If the differential air permeability between non-image area and image area is adjusted to 40,000 seconds or less on a four-color printed paper (between the area printed with four colors and the non-image area), the wrinkling suppression effect becomes more prominent.

The base paper used in the present invention must have a pigment coating layer containing pigments and adhesives formed on it, in order to achieve both high gloss and printability. As long as a pigment coating layer can be formed on it, the base paper is not limited in its specification and any uncoated paper such as wood containing paper, wood free paper, newsprint, paper glossed only on one side or special gravure paper may be used. Formation of a pigment coating layer on an uncoated paper can be adequately achieved through a normal production method of pigment-coated papers. Depending on the desired quality, however, the types of pigments and adhesives contained in the coating material and/or the ratio of pigments and adhesives may be changed as necessary.

The pigments used in the coating layer proposed by the present invention may be any one or more of inorganic pigments, including kaolin, clay, delaminated clay, ground calcium carbonate, precipitated calcium carbonate, talc, titanium dioxide, barium sulfate, calcium sulfate, zinc oxide, silicic acid, silicate, colloidal silica and satin white, as well as organic pigments such as plastic pigments, which have conventionally been used as pigments for the coating layers of coated papers. In the present invention, it is preferable to mix 50 parts by weight or more of kaolin to 100 parts by weight of pigments.

As for the adhesives used in the pigment coating layer proposed by the present invention, any one or more of the following adhesives—which have conventionally been used for coated papers—may be selected as needed: synthetic adhesives such as styrenebutadiene, styrene/acryl, ethylene/vinyl acetate, butadiene/methyl methacrylate, vinyl acetate/butylacrylate and other copolymers, as well as polyvinyl alcohol, maleic anhydride copolymer and acrylate/methyl methacrylate copolymer; proteins such as casein, soybean protein and synthetic protein; starches such as oxidized starch, positive starch, urea/phosphate esterified starch, hydroxyethyl etherified starch and other etherified starches; and dextrin, cellulose derivatives such as carboxymethyl cellulose, hydroxyethyl cellulose and hydroxymethyl cellulose. These adhesives are used at levels of 5 to 50 parts by weight, or preferably 10 to 25 parts by weight, to 100 parts by weight of pigments. In particular, it is preferable to use 13 parts by weight or less of styrene/butadiene copolymer latex to 100 parts by weight of pigments, in order to achieve quicker drying of ink. If necessary, a dispersant, thickener, water-retention agent, antifoamer, water-resistant agent, colorant, printability-enhancing agent and other auxiliaries commonly blended in the coating material compositions for coated papers can be used. To achieve good coating runnability and printability, it is preferable to adjust the solid content of the coating color provided by the present invention to a range between 45 and 65 weight percent.

As for the base paper to be coated on, a paper-based or cardboard-based paper with a basis weight of approximately 25 to 400 g/m$^2$, which is commonly used in general coated papers, is used as deemed appropriate. The production method of the base paper is not limited, and the base paper may be an acid, neutral or alkaline paper produced by a twin-wire paper machine or other Fourdrinier paper machine, a cylinder paper machine, a cardboard paper machine combining Fourdrinier and cylinder machines, a Yankee dryer machine, or the like. Of course, a wood containing pulp or base paper containing recycled pulp can also be used.

It is also possible to use a base paper pre-coated with oxidized starch, positive starch, urea/phosphate esterified starch, hydroxyethyl etherified starch or other etherified starch, dextrin, polyvinyl alcohol or alginic acid using a sizing press, blade, gate-roll coater or pre-metering sizing press, or a base paper pre-coated with one or more layers of a coating color containing pigments and adhesives.

With regard to the pulps that comprise the base paper, any one or more of chemical pulps (bleached or unbleached softwood kraft pulp, bleached or unbleached hardwood kraft pulp, etc.), mechanical pulps (ground pulp, thermo-mechanical pulp, chemical thermo-mechanical pulp, etc.) and deinked pulps (recycled pulp) may be used at desired ratios.

The base paper may have an acid, neutral or alkaline pH level. As for the fillers used in the paper, publicly known fillers, including hydrated silicate, white carbon, talc, kaolin, clay, calcium carbonate, titanium oxide and synthetic-resin filler, may be used. Aluminum sulfate, sizing agent, paper-strengthening agent, yield-enhancing agent, colorant, dye, antifoamer and other agents may be added as necessary.

The prepared coating color can be coated on both sides of the base paper in one or more layers using a blade coater, bar coater, roll coater, air-knife coater, reverse-roll coater, curtain coater, sizing-press coater, gate-roll coater, etc. The coating weight should be preferably 2 to 40 g/m$^2$, or more preferably 5 to 25 g/m$^2$, or at best 8 to 20 g/m$^2$, per side.

The method to dry the wet coating layer may comprise a steam-heating cylinder, hot-air dryer, gas-heater dryer, electric-heater dryer or infrared-heater dryer, or any combination of the above.

Next, a coating color containing surface-sizing agents, as well as plastic pigments if necessary, is coated to provide a surface layer. If necessary, the surface-layer coating color used in the present invention may contain any one or more of natural or synthetic resin adhesives for general coated papers for adjusting the surface strength of the coating layer; flow-adjusting agents or antifoamers for adjusting the coatability of the coating material in the coating process; die-release agents for reducing the deposits on the calender rolls or other rolls; colorants for adding colors to the surface of the coating layer; and small amount of pigments, etc. The coating weight should be normally 0.1 g/m$^2$ or more, or preferably 0.3 to 3 g/m$^2$ or so, per side, which provides a sufficient amount of coating. Application of the surface coating solution can be performed using a blade coater, roll coater or air-knife coater commonly used for coating papers. Drying of the coated surface layer can be implemented under a condition commonly used in the production of coated papers.

It is preferable to smoothen the coated and dried paper produced above, by using a super calender, hot soft nip calender, or the like. In particular, the present invention exhibits a remarkable effect in the production of a coated paper with a basis weight of 25 to 120 g/m$^2$.

The present invention implements a surface layer by coating a mixture of surface-sizing agents and/or plastic pigments over the pigment coating layer formed on the base paper. If necessary, the pigment coating layer can be smoothened before the aforementioned top coating, by using a super calender, gloss calender, hot soft nip calender, or the like.

In the present invention, the air permeability (Oken air permeability) is adjusted to less than 80,000 seconds before printing, and the air permeability in the non-image area after printing is reduced by 8,000 seconds or more from the level before printing. Although any method can be used to achieve the reduction in air permeability, specific approaches include a method to increase the air permeability of the base paper itself by coating a clear mixture containing alginic acids, starches, etc., before applying the pigment coating, a method to coat a surface layer containing sizing agents, plastic pigments, etc., after the pigment coating, or combination of both.

BEST MODE FOR CARRYING OUT THE INVENTION

The surface-sizing agents used in the surface layer proposed by the present invention may be any one or more of styrene/acryl copolymers, styrene/maleic acid copolymers, styrene/methacrylate copolymers, olefin copolymers, urethane copolymers and other copolymers. The sizing agents used in the present invention are a solution or emulsion that does not retain particle shape after hot-air drying or calendering. Among others, it is preferable to use styrene/acryl copolymers, olefin copolymers and styrene/maleic acid copolymers. In particular, use of a styrene/acryl sizing agent by itself or in combination with other sizing agent(s) will provide a higher sheet gloss. The average molecular weight of a polymer should preferably be 1,000 to 500,000.

The plastic pigments used in the surface layer proposed by the present invention are polymer or copolymer emulsion particles exhibiting thermoplasticity. It is preferable to use pigment particles with a glass transition point of 80° C. or above, so that the particle shape is retained after hot-air drying or calendering. In the case of core-shell type pigment particles, the glass transition temperature of the shell part should be 80° C. or above. As long as a glass transition temperature of 80° C. or above is ensured, the types of monomers comprising each polymer or copolymer, and the production method of the polymer/copolymer, are not important. However, examples of preferred monomers include styrene and its derivatives, vinylidene chlorides, and acrylate or methacrylate esters. The maximum glass transition temperature of thermoplastic polymers is not specified. The maximum glass transition temperature of a thermoplastic polymer is determined mainly by the types of monomers and additives, such as plasticizers, used in the production of the thermoplastic polymer, and is generally around 130° C. If polymers or copolymers with a glass transition temperature of below 80° C. is used, the obtained coated paper will have low gloss and may also cause the ink to attach to the calender rolls during calendering. In addition, the average size of the thermoplastic polymer particles used in the present invention should be preferably 150 nm or less, but more preferably 100 nm or less, in order to ensure high gloss and surface strength.

In the present invention, it is preferable to apply on the pigment coating layer a surface layer that comprises plastic pigments and surface-sizing agents mixed together. However, the surface-layer coating color may contain any one or more of natural or synthetic resin adhesives for general coated papers for adjusting the surface strength of the coating layer; flow-adjusting agents or antifoamers for adjusting the coating runnability of the coating material in the coating process; die-release agents for reducing the deposits on the calender rolls or other rolls; colorants for adding colors to the surface of the coating layer; and small amount of pigments, etc., provided that use of such additives will not affect the purpose of the present invention. Preferably, the surface layer should contain 80 to 100 weight percent by solid content of plastic pigments and surface-sizing agents. Thus obtained surface-layer coating color is applied over the pigment coating layer to provide a surface layer. The coating weight can be adjusted as needed to obtain the desired properties. However, an excessive coating weight not only adds to cost, but it also causes unwanted properties to manifest such as lower ink absorbency, which causes ink setting problem, and lower strength of the surface layer. Therefore, it is not wise to apply an overly large amount of the surface-layer coating color, and normally a coating weight of 0.1 g/m$^2$ or more, or preferably 0.3 to 3 g/m$^2$, per side is sufficient.

Application of the surface-layer coating color can be achieved using a blade coater, roll coater, air-knife coater, bar coater, gravure coater, flexible coater or other coater commonly used for coating papers.

Drying of the coated paper requires no specific requirement, if the thermoplastic copolymers and surface-sizing agents proposed by the present invention are used, in which case an optimal surface layer can be achieved under a drying condition commonly used in the production of coated papers.

Thus obtained coated printing paper can be processed into a high-gloss coated printing paper through calendering. Caldendering can be performed using a super calender, gloss calender, high-temperature soft-nip calender or other calender commonly used in the smoothing of coated papers, or any combination of the above. Under the present invention, good separability of the coating surface and calender rolls can be achieved even when calendering is performed at a metal roll temperature of 100° C. or above, or even 150° C. or above.

In implementing the present invention, the wrinkling suppression effect can be improved and the paper will manifest higher gloss if the moisture content of the coated paper is adjusted to 4.5 percent or less, or preferably 4.0 percent or less.

EXAMPLES

The following is a detailed explanation of this invention using examples and comparative examples. However, the present invention is not limited to the examples and comparative examples provided herein.

Unless otherwise specified, the part(s) and percent used in the examples and comparative examples refer to the part(s) by weight of solid content and weight percent of solid content, respectively.

<Evaluation Methods>

(1) Wrinkling: A sample paper was printed using a web offset press, and the wrinkling in the image area in four colors (ink density: black 1.80, cyan 1.50, magenta 1.45, yellow 1.05, total density of four colors 5.80; measured with X-Rite 408 manufactured by X-Rite) was visually evaluated according to the following standards: ⊙ Little wrinkling, ○ Very minor wrinkling, Δ Some wrinkling, X Significant wrinkling.

(2) Blister resistance: A sample paper was printed using a web offset press, and the blister resistance in the area printed in four colors (ink density: black 1.80, cyan 1.50, magenta 1.45, yellow 1.05, total density of four colors 5.80; measured with X-Rite 408 manufactured by X-Rite) was evaluated based on the paper surface temperature at which blistering occurred.

(3) White paper gloss: Measurement was performed in accordance with JIS P 8142.

(4) Wetness/impression stability: A sample paper was printed using a web offset press, and the wetness/impression stability in the area printed in cyan (ink density: cyan 1.50; measured with X-Rite 408 manufactured by X-Rite; printed in the order of black→cyan→magenta→yellow) was visually evaluated according to the following standards: ⊙ Very good, ○ Good, Δ Average, X Poor.

(5) Surface strength: A sample paper was printed using a web offset press, and the surface strength (peeling) in the area printed in cyan (ink density: cyan 1.50; measured with X-Rite 408 manufactured by X-Rite; printed in the order of black→cyan→magenta→yellow) was visually evaluated according to the following standards: ⊙ Very good, ○ Good, Δ Average, X Poor.

(6) Air permeability: A sample paper was printed using a web offset press, and the air permeabilities in the white area before printing, as well as in the non-image area after printing and area printed in four colors (ink density: black 1.80, cyan 1.50, magenta 1.45, yellow 1.05, total density of four colors 5.80; measured with X-Rite 408 manufactured by X-Rite) were measured in accordance with J. TAPPI paper-pulp test method No. 5 (B).

Example 1

Pigments consisting of 50 parts of fine clay (DB-GRAZE, manufactured by IMERYS) and 50 parts of fine ground calcium carbonate (FMT-90, manufactured by Faimatech) were mixed with a dispersant consisting of 0.2 part of sodium polyacrylate to the pigments, and then the mixture was dispersed in a Serie mixer to obtain a pigment slurry of 70 percent solid content. The obtained pigment slurry was further mixed with 10 parts of styrene butadiene latex, 5 parts of hydroxyethyl etherified starch and water to obtain a coating color of 64 percent solid content. A wood free paper with a basis weight of 40.0 g/m$^2$, pre-coated with 1.0 g/m$^2$ of hydroxyethyl etherified starch per side using a gate-roll coater, was coated on both sides with the coating color using a blade coater (jet-fountain type applicator) operated at a coating speed of 1,000 m/min in such a way that the coating weight on each side became 11.0 g/m$^2$ by solid content, and then the coated paper was dried until its moisture content dropped to 4.0 percent. To provide a surface layer, a mixture consisting of 20 parts of small plastic pigment particles (glass transition point 100° C., average particle size 100 μm) and 80 parts of styrene/acryl surface-sizing agent (K-12, manufactured by Harima Chemicals) was coated on both sides of the paper using a blade coater (jet-fountain type applicator) operated at a coating speed of 1,000 m/min in such a way that the coating weight on each side became 0.7 g/m$^2$ by solid content, and then the coated paper was dried until its moisture content dropped to 3.8 percent.

Then, soft-nip calendering was performed on the paper at a roll surface temperature of 80° C., calender line pressure of 250 kg/cm (four nips) and paper feed rate of 500 m/min, to obtain a coated sheet for web offset printing with a moisture content of 3.5 percent.

Example 2

A coated sheet for web offset printing was obtained in the same manner as described in Example 1, except that the moisture content of the pigment-coated paper was adjusted to 6.5 percent, that of the paper having a surface coating layer on its pigment coating layer to 5.5 percent, and that of the paper after calendering to 4.8 percent.

Example 3

A coated sheet for web offset printing was obtained in the same manner as described in Example 1, except that a mixture consisting of 45 parts of small plastic pigment particles (glass transition point 100° C., average particle size 100 nm) and 55 parts of styrene/acryl surface-sizing agent was coated as a surface layer on both sides of the paper using a blade coater (jet-fountain type applicator) operated at a coating speed of 1,000 m/min in such a way that the coating weight on each side became 1.0 g/m$^2$ by solid content.

Example 4

A coated sheet for web offset printing was obtained in the same manner as described in Example 1, except that no calendering was performed.

Example 5

A coated sheet for web offset printing was obtained in the same manner as described in Example 1, except that the small plastic pigment particles (glass transition temperature 100° C., average particle size 100 nm) were changed to another type of small plastic pigment particles (glass transition temperature 90° C., average particle size 140 nm).

Example 6

A coated sheet for web offset printing was obtained in the same manner as described in Example 1, except that a mixture consisting of 2 parts of small plastic pigment particles (glass transition temperature 100° C., average particle size 100 nm) and 98 parts of styrene/acryl surface-sizing agent was coated as a surface layer on both sides of the paper using a blade coater (jet-fountain type applicator) operated at a coating speed of 1,000 m/min in such a way that the coating weight on each side became 0.7 g/m$^2$ by solid content.

Example 7

A coated sheet for web offset printing was obtained in the same manner as described in Example 1, except that a mixture consisting of 60 parts of small plastic pigment particles (glass transition temperature 100° C., average particle size 100 nm) and 40 parts of styrene/acryl surface-sizing agent was coated as a surface layer on both sides of the paper using a blade coater (jet-fountain type applicator) operated at a coating speed of 1,000 m/min in such a way that the coating weight on each side became 0.7 g/m$^2$ by solid content.

Comparative Example 1

A coated sheet for web offset printing was obtained in the same manner as described in Example 1, except that a wood free paper with a basis weight of 40 g/m$^2$, pre-coated with 0.8 g/m$^2$ of hydroxyethyl etherified starch per side using a gate-roll coater, was used and that no surface layer was formed.

Comparative Example 2

A coated sheet for web offset printing was obtained in the same manner as described in Example 1, except that a wood free paper with a basis weight of 40 g/m$^2$, pre-coated with 3.0 g/m$^2$ of PVA per side using a gate-roll coater, was coated on both sides with the coating color using a blade coater (jet-fountain type applicator) operated at a coating speed of 1,000 m/min in such a way that the coating weight on each side became 12.0 g/m$^2$ by solid content, and that no surface layer was formed.

The results of the above examples and comparative examples are shown in Table 1.

TABLE 1

| | Wrinkling | Blister occurring temperature (° C.) | Sheet gloss (%) | Wetness/ impression stability | Surface strength |
|---|---|---|---|---|---|
| Example 1 | ⊙ | 150 | 75 | ⊙ | ⊙ |
| Example 2 | ○ | 150 | 80 | ⊙ | ⊙ |
| Example 3 | ○ | 150 | 75 | ⊙ | ⊙ |
| Example 4 | ⊙ | 150 | 62 | ⊙ | ⊙ |
| Example 5 | ⊙ | 150 | 75 | ⊙ | ○ |
| Example 6 | ⊙ | 150 | 74 | Δ | ⊙ |
| Example 7 | Δ | 150 | 75 | ⊙ | ⊙ |
| Comparative example 1 | X | 130 | 62 | ⊙ | ⊙ |
| Comparative example 2 | ○ | 100 | 61 | ⊙ | ⊙ |

As shown in Table 1, examples 1 through 5 all provided a coated sheet for web offset printing that caused little or very minor wrinkling and exhibited excellent blister resistance and wetness/impression stability. The paper obtained by comparative example 1 caused significant wrinkling and one obtained by comparative example 2 had lower blister resistance.

Example 8

Pigments consisting of 60 parts of fine clay (DB-GRAZE, manufactured by IMERYS) and 40 parts of fine ground calcium carbonate (FMT-90, manufactured by Faimatech) were mixed with a dispersant consisting of 0.2 part of sodium polyacrylate to the pigments, and then the mixture was dispersed in a Serie mixer to obtain a pigment slurry of 70 percent solid content.

The obtained pigment slurry was further mixed with 10 parts of styrene butadiene latex, 5 parts of hydroxyethyl etherified starch and water to obtain a coating color of 64 percent solid content. A wood free paper with a basis weight of 40.0 g/m$^2$, pre-coated with 2.0 g/m$^2$ of a mixture of alginic acid and hydroxyethyl etherified starch (solid content ratio 1:50) per side using a gate-roll coater, was coated on both sides with the coating color using a blade coater (jet-fountain type applicator) operated at a coating speed of 1,000 m/min in such a way that the coating weight on each side became 11.0 g/m$^2$ by solid content, and then the coated paper was dried until its moisture content dropped to 5.5 percent. To provide a surface layer, a mixture consisting of small plastic pigment particles (glass transition point 100° C., average particle size 0.1 μm) and styrene/acryl surface-sizing agent (solid content ratio 1:1) was coated on both sides of the paper using a blade coater (jet-fountain type applicator) operated at a coating speed of 1,000 m/min in such a way that the coating weight on each side became 0.7 g/m$^2$ by solid content.

Then, soft-nip calendering was performed on the paper at a roll surface temperature of 80° C., calender line pressure of 200 kg/cm (four nips) and paper feed rate of 300 m/min, to obtain a coated sheet for web offset printing.

Example 9

A coated sheet for web offset printing was obtained in the same manner as described in Example 8, except that a wood free paper with a basis weight of 40.0 g/m$^2$, pre-coated with 1.0 g/m$^2$ of hydroxyethyl etherified starch per side using a gate-roll coater, was used and that a mixture consisting of small plastic pigment particles (glass transition temperature 100° C., average particle size 0.1 μm) and styrene/acryl surface-sizing agent (solid content ratio 1:1) was coated as a surface layer on both sides of the paper using a blade coater (jet-fountain type applicator) operated at a coating speed of 1,000 m/min in such a way that the coating weight on each side became 1.0 g/m$^2$ by solid content.

Example 10

A coated sheet for web offset printing was obtained in the same manner as described in Example 8, except that a wood free paper with a basis weight of 40.0 g/m2, pre-coated with 1.0 g/m$^2$ of hydroxyethyl etherified starch per side using a gate-roll coater, was used and that a mixture consisting of small plastic pigment particles (glass transition point 100° C., average particle size 0.1 μm) and styrene/acryl surface-sizing agent (solid content ratio 1:1) was coated as a surface layer on both sides of the paper using a blade coater (jet-fountain type applicator) operated at a coating speed of 1,000 m/min in such a way that the coating weight on each side became 1.5 g/m$^2$ by solid content.

Comparative Example 3

A coated sheet for web offset printing was obtained in the same manner as described in Example 8, except that a wood free paper with a basis weight of 40 g/m$^2$, pre-coated with 1.0 g/m$^2$ of hydroxyethyl etherified starch per side using a gate-roll coater, was used and that no surface layer was formed.

Comparative Example 4

A coated sheet for web offset printing was obtained in the same manner as described in Example 8, except that a wood free paper with a basis weight of 40 g/m$^2$, pre-coated with 3.0 g/m$^2$ of PVA per side using a gate-roll coater, was coated on both sides with the coating color using a blade coater (jet-fountain type applicator) operated at a coating speed of 1,000 m/min in such a way that the coating weight on each side became 12.0 g/m$^2$ by solid content, and that no surface layer was formed.

The results of the above examples and comparative examples are shown in Table 2.

TABLE 2

| | Wrinkling | Blister occurring temperature (° C.) | Air permeability sec Sheet | Non-image area | Image area | Sheet gloss (%) |
|---|---|---|---|---|---|---|
| Example 8 | ⊙ | 150 | 60000 | 30000 | 60000 | 70 |
| Example 9 | ⊙ | 150 | 65000 | 25000 | 55000 | 73 |
| Example 10 | ⊙ | 130 | 75000 | 35000 | 65000 | 75 |
| Comparative example 3 | X | 130 | 12000 | 10000 | 70000 | 60 |
| Comparative example 4 | ○ | 100 | 90000 | 90000 | 100000 or more | 60 |

As shown in Table 2, examples 8 through 10 all provided a coated sheet for web offset printing that caused little wrinkling and exhibited excellent blister resistance. The paper obtained by comparative example 3 caused significant wrinkling and one obtained by comparative example 4 had lower blister resistance.

Example 11

Fifty parts of fine clay (DB-GRAZE, manufactured by IMERYS), 50 parts of fine ground calcium carbonate (FMT-90, manufactured by Faimatech), 10 parts of styrene-butadiene copolymer latex for web offset printing with a gel content of 55 percent, and 4 parts of starch were mixed to prepare a coating color for coated paper having 64 percent solid content. The obtained coating color was coated on both sides of a wood free paper with a basis weight of 12.7 g/m$^2$ using a blade coater operated at a coating speed of 500 m/min in such a way that the dry weight on each side became 14 g/m$^2$, in order to obtain a paper for top coating having a pigment coating layer on each side and a moisture content of 5.5 percent (pigment-coated paper).

One hundred parts of styrene/acryl surface-sizing agent (NS-15-1, manufactured by Arakawa Chemical Industries) and 5 parts of polyethylene wax emulsion die-release agent were mixed to obtain a surface-layer coating color of 30 percent solid content.

The obtained coating color was coated on the aforementioned paper (pigment-coated paper) using a blade coater operated at a coating speed of 500 m/min in such a way that the dry weight on each side became 1.0 g/m$^2$, and then the coated paper was dried to a moisture content of 6.5 percent to obtain a top-coated paper. Thereafter, the top-coated paper was fed through a super calender consisting of chilled rolls (65° C.) and cotton rolls for two nips at a nip pressure of 180 kg/cm and feed rate of 10 m/min to obtain a coated sheet for web offset printing.

Example 12

A coated sheet for web offset printing was obtained in the same manner as described in Example 11, except that the surface-sizing agent used in Example 11 was changed to an olefin sizing agent (Polymalon 482S, manufactured by Arakawa Chemical Industries).

Example 13

A coated sheet for web offset printing was obtained in the same manner as described in Example 11, except that the surface-sizing agent used in Example 11 was changed to a styrene/maleic acid sizing agent (K-4, manufactured by Harima Chemicals).

Comparative Example 5

A coated sheet for web offset printing was obtained in the same manner as described in Example 11, except that no surface layer was formed.

The results of quality evaluation tests performed on the obtained coated sheet for web offset printings are shown in Table 3.

TABLE 3

| | Wrinkling | Wetness/impression stability |
|---|---|---|
| Example 11 | ⊙ | ○ |
| Example 12 | ⊙ | ○ |
| Example 13 | ⊙ | ○ |
| Comparative Example 5 | X | ○ |

As shown in Table 3, the coated sheet for web offset printings obtained by the present invention caused little wrinkling and offered good wetness/impression stability. The paper obtained by the comparative example failed to suppress wrinkling.

INDUSTRIAL FIELD OF APPLICATION

The present invention prevents wrinkling and mottled ink impression during web offset printing or in the drying process after web offset printing, by providing a pigment coating layer on the base paper, and then forming a surface layer on the pigment coating layer through application and drying of a coating solution containing surface-sizing agents. It also provides a coated sheet for web offset printing that suppresses wrinkling and offers excellent blister resistance, white paper gloss and other properties by way of mixing surface-sizing agents and plastic pigments into the surface layer.

What is claimed is:

1. A coated sheet for web offset printing which is hot-air dried or calendered and comprises:

a base paper, a coating layer formed on the base paper, and a surface layer formed on the coating layer, wherein said coating layer comprises a pigment and an adhesive, and said surface layer comprises (i) at least one surface-sizing agent selected from the group consisting of styrene/acryl copolymers, olefin copolymers, and styrene/maleic acid copolymers and (ii) a plastic pigment having a glass transition temperature of about 80° C. or above and an average particle size of about 150 nm or less, wherein the surface-sizing agent does not retain particle shape after hot-air drying or calendaring, whereas the plastic pigment retains particle shape after hot-air drying or calendaring, and wherein the plastic pigments and surface-sizing agent account for 80 to 100 weight percent by solid content of the surface layer.

2. The coated sheet for web offset printing as described in claim 1, wherein an air permeability of said sheet before printing is less than 80,000 seconds and the air permeability in a non-image area after printing decreases by 8,000 seconds or more from the level before printing.

3. The coated sheet for web offset printing as described in claim 2, wherein the differential air permeability after printing between the non-image area and an area printed in four colors is 40,000 seconds or less.

4. The coated sheet for web offset printing as described in claim 1, wherein said plastic pigment has a glass transition temperature of about 80° C. to about 130° C.

5. The coated sheet for web offset printing as described in claim 1, wherein said plastic pigment has an average particle size of about 100 nm or less.

6. The coated sheet for web offset printing as described in claim 1, wherein the amount of said surface-sizing agent is about 50 parts by weight or more but not exceeding about 95 parts by weight, to 100 parts by weight of all surface-sizing agent and plastic pigment combined.

7. The coated sheet for web offset printing as described in claim 1, wherein the surface layer consists of the plastic pigment and the surface-sizing agent.

8. The coated sheet for web offset printing as described in claim 1, wherein the surface-sizing agent has an average molecular weight of 1,000 to 500,000.

9. The coated sheet for web offset printing as described in claim 1, wherein the plastic pigment is made from monomers selected from the group consisting of styrene and its derivatives, vinylidene chlorides, and acrylate or methacrylate esters.

10. The coated sheet for web offset printing as described in claim 1 wherein the surface layer is applied at a coating weight of 0.3 to 3 $g/m^2$, per side.

11. The coated sheet for web offset printing as described in claim 1, which is calendered.

12. A web offset printed sheet comprising the coated sheet according to claim 1 wherein the coated sheet is printed in four colors and includes a printed area and a non-image area, wherein the differential air permeability between the non-image area and the printed area is 40,000 seconds or less.

* * * * *